US005308065A

United States Patent [19]

Bridgeman et al.

[11] Patent Number: 5,308,065

[45] Date of Patent: May 3, 1994

[54] DRAW POKER WITH RANDOM WILD-CARD DETERMINATION

[76] Inventors: James L. Bridgeman; Nancy L. Bridgeman; Lance F. Bridgeman; Jerry K. Bridgeman; Stephanie A. Bridgeman; Robert J. Bridgeman, all of 9582 Hamilton Ave., Huntington Beach, Calif. 92646

[21] Appl. No.: 948,026

[22] Filed: Sep. 21, 1992

[51] Int. Cl.[5] ..... A63F 1/00

[52] U.S. Cl. ..... 273/85 CP; 273/85 G; 273/138 A; 273/274; 364/412

[58] Field of Search ..... 273/138 A, 85 CP, 85 G, 273/292, 274, 303, 269, DIG. 28; 364/412

[56] References Cited

U.S. PATENT DOCUMENTS

| | | | |
|---|---|---|---|
| 4,624,459 | 11/1986 | Kaufman | 273/138 A X |
| 4,648,604 | 3/1987 | Horan | 273/292 |
| 4,743,022 | 5/1988 | Wood | 273/85 CP |
| 5,019,973 | 5/1991 | Wilcox et al. | 273/85 CF |
| 5,022,653 | 6/1991 | Suttle et al. | 273/85 CP |
| 5,033,744 | 7/1991 | Bridgeman et al. | 273/85 CP |
| 5,042,818 | 8/1991 | Weingardt | 273/85 CP |
| 5,100,137 | 3/1992 | Fulton | 273/85 CP |

OTHER PUBLICATIONS

Scarne's Encyclopedia of Games by John Scarne, copyright 1973, Harper & Row, New York pp. all of chapter 2.

*Primary Examiner*—Vincent Millin
*Assistant Examiner*—Sebastiano Passaniti

[57] ABSTRACT

A game of chance and skill where a player, after making a wager, is dealt, face-up, a hand of five cards which is placed in a player-hand area (122). The player also receives a solitary card, which is dealt face down in a single-card area (124). The player then has a chance to improve the ranking of the five-card hand by discarding up to five cards and replacing them with an equal number of new cards. After the player rearranges the five-card hand, the solitary card is turned face-up and all the cards in the player's hand which have the same face value as the solitary card are designated wild. The ranking winnings are calculated according to a statistical pay table.

20 Claims, 4 Drawing Sheets

DRAW POKER WITH RANDOM WILD-CARD DETERMINATION

BACKGROUND

1. Field of the Invention

The present invention relates to a game of chance and skill, specifically to a card game which is particularly suitable for use in casinos and which can be played either as a computer video game or as a table game.

2. Description of Prior Art

A wagering game played in casino establishments in the U. S. should meet the following criteria: (1) the game must be entertaining for the players and it should attract certain amounts of wagers during predetermined time periods; (2) the game must provide reasonable odds to the player; (3) the game must have unvarying overall odds in favor of the casino; and (4) the game must be simple and easily monitored by observers and the dealer to avoid errors and cheating.

U.S. Pat. No. 4,743,022 to Michael Wood, 1988, discloses a poker game which can be played on a computer video screen or as a table game. At the start of the game, the player makes a first wager and receives five cards, which constitute a first hand. As is known to those skilled in the art, five-card poker hands are ranked, for competitive purposes, according to the following order from lowest to highest: (1) High Card in Hand; (2) One Pair; (3) Two Pair; (4) Three of a Kind; (5) Straight; (6) Flush; (7) Full House; (8) Four of a Kind; (9) Straight Flush; (10) Royal Flush; (11) Five of a Kind (which is possible only if a joker is used).

Then each player may discard up to five cards and receive five new cards to form a second hand. The player loses the first wager if the second hand (or the first hand when no cards are discarded) does not have a pair. The player receives the wager back if the hand has a pair. The player receives a payout which exceeds the first wager in accordance with the posted odds if the hand is of higher order than a pair.

The player is also entitled to make a second wager and to receive a sixth card. A five-card third hand having the highest possible ranking is then formed by combining the newly dealt card and any four of the five cards in the second hand. If the third hand is ranked lower than a straight and is of lower order than the second hand, the player loses the second wager. However, if the third hand has a ranking of a straight or greater and is of higher order than the second hand, the player wins an amount which depends on the second wager and the posted odds.

Although Wood's game allows the player an additional possibility of winning by providing the sixth card, the payout odds must be diminished proportionally, thus decreasing the generated level of excitement. Moreover, the thrill of the game is also reduced because the sixth card rarely produces a dramatic improvement in the ranking of the player's hand. Furthermore, the rules of the game are fairly complex, involving three different hands and sometimes enigmatic criteria for receiving the sixth card (the video-game version).

Several wild-card versions of Wood's game have been suitable for casinos. In these, a wild card may possess any value specified by the player. For example, when deuces are wild, they can be counted as kings, aces, or have any other value and can fill in straights or flushes. Other variations of the game exist, for instance with jokers or eights wild.

However, when wild cards are used, the game lacks the exciting element of surprise since the wild cards are declared to the player at the start of the game. Moreover, the game is rendered less attractive because the player always retains the wild cards and hence a lower pay table must be utilized. Thus, the player normally wins only when his or her hand ranking is three of a kind or higher.

OBJECTS AND ADVANTAGES

It is accordingly an object of the invention to provide a card game of chance and skill which is profitable to casinos and attractive to players because it yields large payouts on small wagers. Other objects are to furnish a card game which is played quickly and which offers an exciting element of surprise. Further objects and advantages will become apparent after consideration of the ensuing description and the accompanying drawings.

DRAWING FIGURES

REFERENCE NUMERALS USED IN THE DRAWINGS AND DESCRIPTIONS

30—cabinet
32—video-display screen
34—upper control panel
36—coin inlet
38—single-bet button
40—maximum-bet button
42—collect button
44—lower control panel
46—deal/draw button
48—hold/cancel buttons
52—coin outlet
54—player-hand area
56—wild-card area
58—guiding symbols
68—Central Processing Unit
70—clock circuit
72—memory
74—interface circuit
76—video-display circuit
78—coin-hopper circuit
80—data-storage circuit
82—Read-And-write Memory
84—Read-Only Memory
86—sound generator
88—light circuit
80, 102, 114—drive circuits
92, 106, 112—buffers
94, 104, 110—input/output ports
96—video circuit
98—cathode-ray-tube controller
100—coin hopper
108—disk drive 110-118—flow-chart steps
120—player station
122—player-hand area
124—single-card area

FIG. 1—DESCRIPTION OF VIDEO CARD-GAME MACHINE

Figure 1:
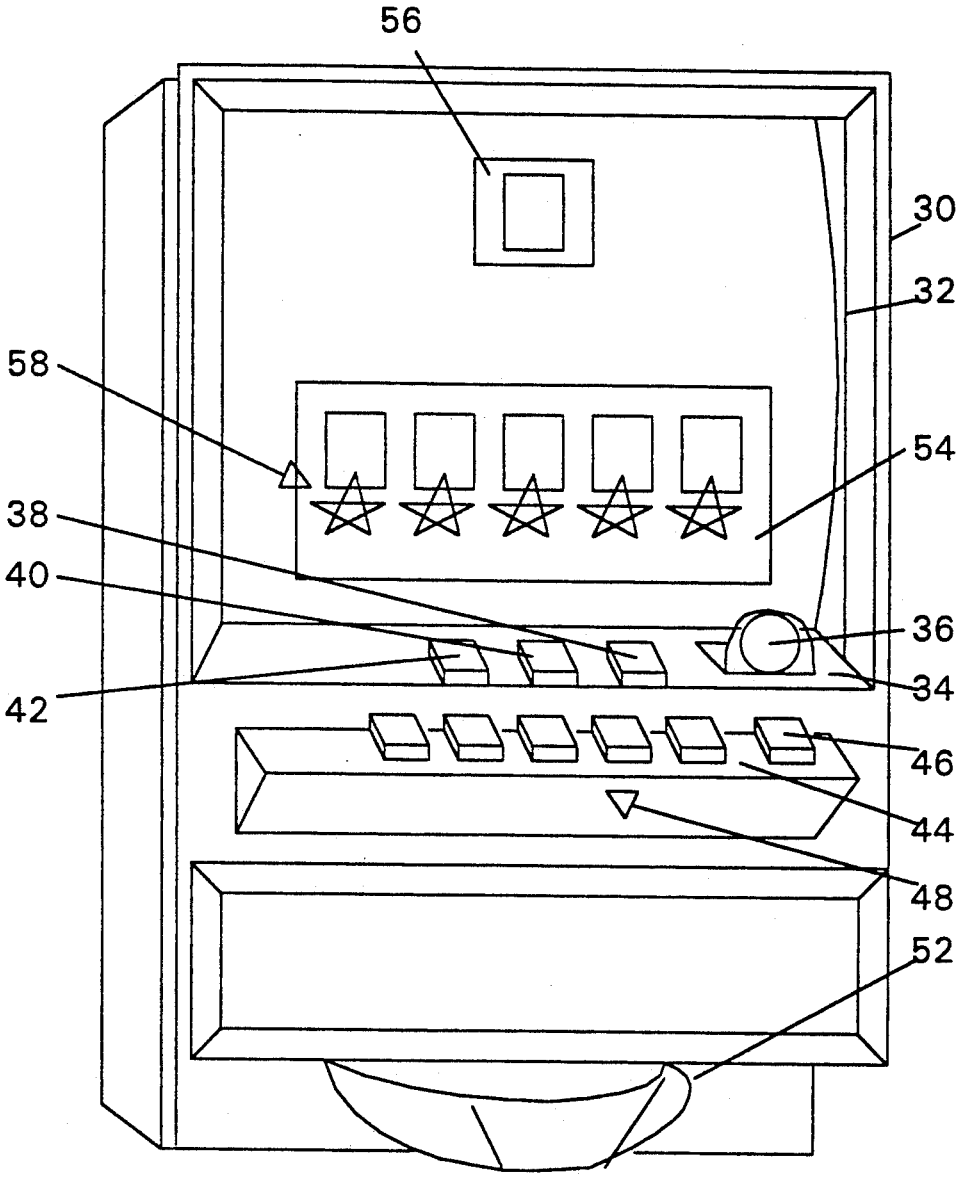
FIG. 1 is a perspective view of a video card-game apparatus according to the invention.

A perspective view of a video card-game machine according to the present invention is shown in FIG. 1.

The machine comprises a cabinet 30 which contains a video-display screen 32, e.g., a cathode ray tube. An upper control panel 34, located below screen 32, accommodates a coin inlet 36, a single-bet button 38, a maximum-bet button 40, and a collect button 42. A lower control panel 44, which is situated beneath panel 34, includes a deal/draw button 46, and hold/cancel buttons 48. Inlet 36 connects to a coin hopper 100 (FIG. 2) which stores coins and dispenses payoffs through a coin outlet 52, located at the bottom of cabinet 30.

In one specific embodiment of the invention, cabinet 30 is about 100 cm high, 45 cm wide, and 45 cm deep.

Screen 32 contains a player-hand area 54 which displays five cards and a wild-card area 56 which displays one card. Star-shaped guiding symbols 58, which flash when appropriate, are located in area 54. Each of the cards situated in area 54 has one corresponding symbol 58.

FIG. 2—DETAILED DESCRIPTION OF HARDWARE

Figure 2:
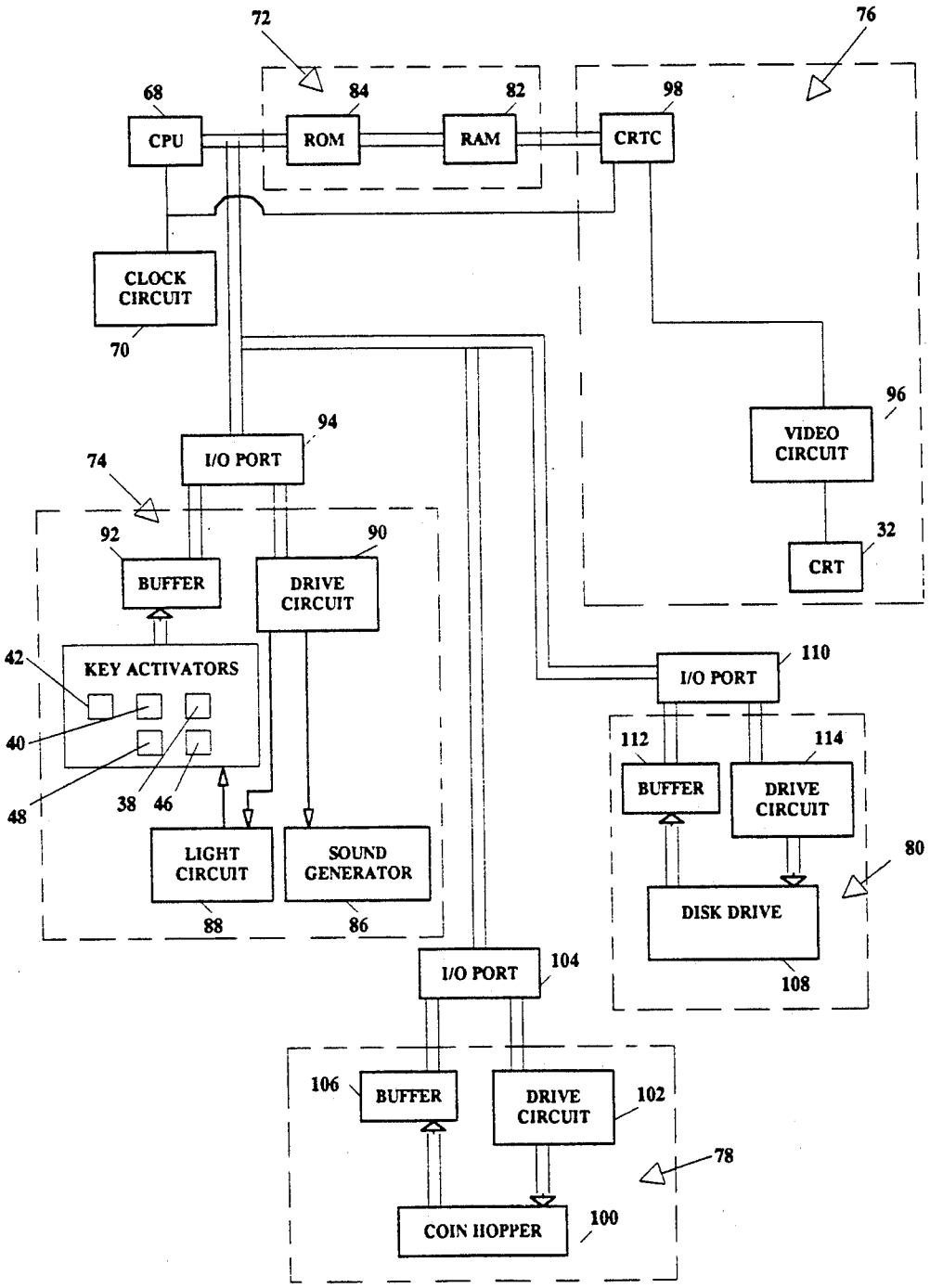
FIG. 2 is a block diagram of an electronic circuit of the video card-game apparatus of FIG. 1.

A block diagram of the electronic circuit of the video card-game apparatus is shown in FIG. 2.

The electronic circuit of the apparatus includes a CPU (Central Processing Unit) 68 which is connected to a clock circuit 70, a memory 72, an interface circuit 74, a video-display circuit 76, a coin-hopper circuit 78, and a data-storage circuit 80.

Memory 72 is composed of a Read-And-write Memory (RAM) 82 and a Read-Only-Memory (ROM) 84. RAM 82 stores the game's variables and is battery backed. Thus, when the card-game apparatus is disconnected from its main power supply, the data stored in RAM 82 is preserved for approximately ten years. ROM 84 contains information such as image patterns (memory bit maps) for the playing cards as well as the operating instructions for CPU 68.

Interface circuit 74 incorporates a sound generator 86 and key activators, including single-bet button 38, maximum-bet button 40, collect button 42, deal/draw button 46, and hold/cancel buttons 48. A light circuit 88, designed to illuminate those key activators ready to accept input data, is controlled by a drive circuit 90. Since CPU 68 is a single-task processor, a buffer 92, which stores activator-key input information, is placed before an input/output port 94 of the CPU. Drive circuit 90 is electronically linked to sound generator 86, which signals to acknowledge activation of buttons or an occurrence of a win.

Video-display circuit 76 includes screen 32 (e.g., a cathode ray tube) having a video circuit 96, electronically connected to a cathode-ray-tube controller 98. As controller 98 reads out an image pattern (memory bit map) for a playing card from ROM 84 to RAM 82, it converts this data to a serial data format and sends it to video circuit 96. Based on the video signals generated by circuit 96, a predetermined image appears on screen 32.

Coin-hopper circuit 78 incorporates electro-mechanical coin hopper 100, which is controlled by a drive circuit 102. Circuit 102 governs such functions as credit detection (tracking of cumulative player winnings), lock out (shut down of the game apparatus in case the jackpot is too large to be paid by the machine), and coin release. CPU 68 receives data from hopper 100 through an input-output port 104 via a buffer 106. Hopper 100 must be able to store coins and make payoffs accurately and is always monitored by CPU 68. If hopper 100 malfunctions, the card-game apparatus shuts down automatically and messages, such as "RUNAWAY HOPPER" AND "HOPPER EMPTY", are displayed on screen 32.

Data-storage circuit 80 comprises a disk drive 108, connected to an input-output port 110 of CPU 68 through a buffer 112. Disk drive 108 is controlled by a drive circuit 114 and stores such statistics as number of rounds played, winnings amounts, percentage of hold in favor of the casino, and other game information. A management key (not shown) may be used by authorized personnel to display the aforementioned data or to obtain printouts through hard-copy devices (also not shown).

Clock circuit 70 sends out clock signals to time the operations of CPU 68 and CRT controller 98. For example, circuit 70 times the operations of coin hopper 100 and the duration of messages, such as "INSERT COIN", which appear on screen 32.

Other hardware and parts of the above described card-game apparatus are similar to those used in existing video poker machines. Standard components include coin hoppers, coin acceptors, IBM-compatible computers, video-display screens, and VGA graphic-display cards.

Figure 3:
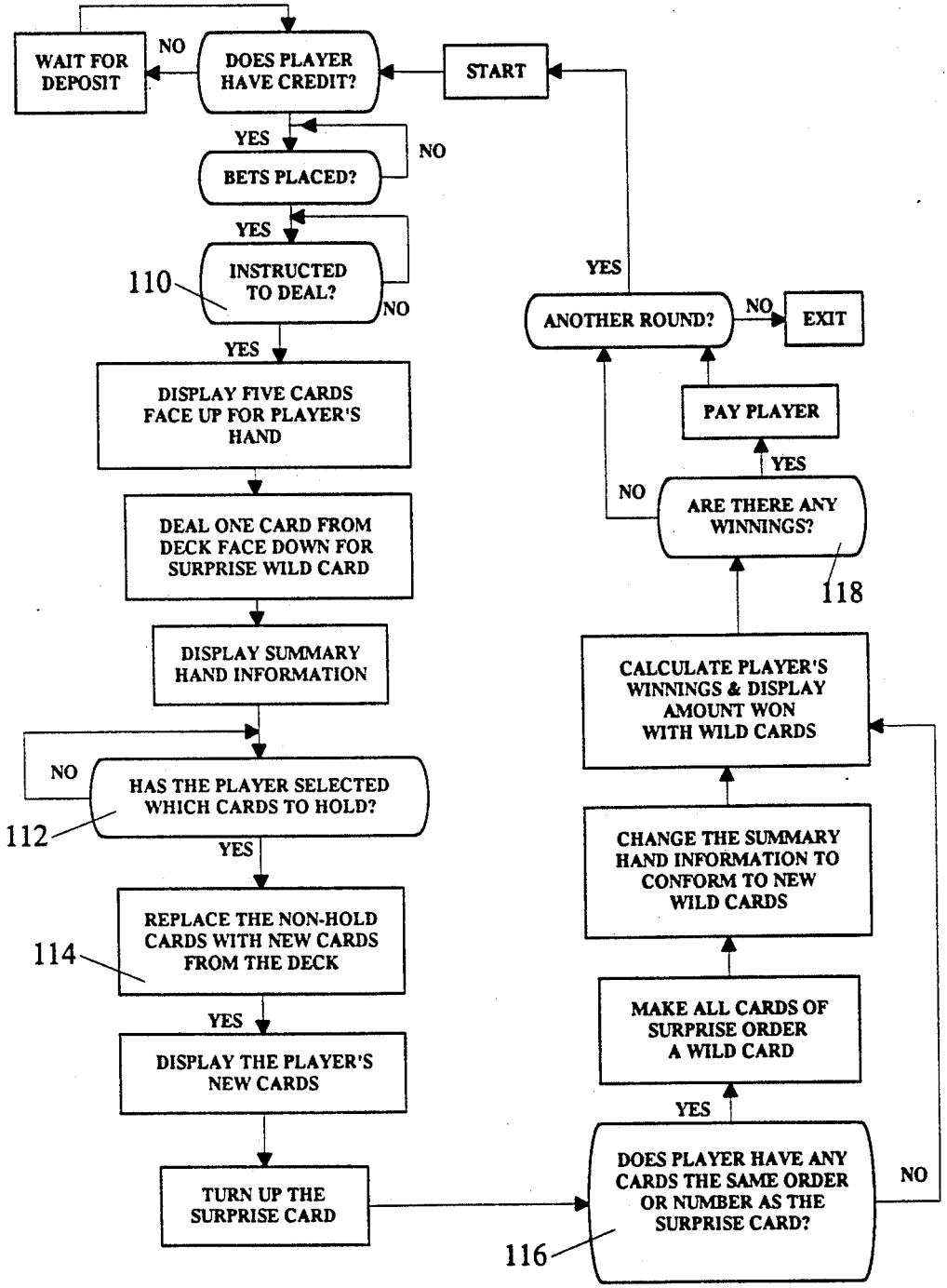
FIG. 3 is a flow chart which illustrates the sequence of logical operations performed by the central processing unit of the video card-game apparatus of FIG. 1 for draw poker with surprise, randomly-determined wild cards.

FIGS. 1, 2, and 3—OPERATION OF VIDEO CARD-GAME MACHINE—DRAW POKER WITH SURPRISE, RANDOMLY-DETERMINED WILD CARDS FIG. 3 shows a flow chart which illustrates the sequence of logical operations performed by CPU 68. The ensuing operation description refers to the major steps of the flow chart, cited parenthetically.

To start the game, the player inserts the proper number of coins or tokens into coin inlet 36. The player then chooses the amount he or she wants to wager either by repeatedly pressing single-bet button 38 or by pressing maximum-bet button 40 once to bet one or more coins, up to the wager limit.

To receive a hand of five cards (i.e., a small set), which appear face up in player-hand area 54, the player activates deal/draw button 46 (Step 110). Simultaneously, a single card appears face down in wild-card area 56. CPU 68 randomly generates these cards from a pool comprising scorable units or elements corresponding to a deck of 52 standard playing cards (i.e., a maximum set), which ranked from low to high in the order of 2, 3, 4, 5, 6, 7, 8, 9, 10, Jack, Queen, King, and Ace.

The cards in player-hand area 54 are automatically arranged in order of increasing rank, and appropriate guiding means or symbols 58 are illuminated to help the player identify One Pair, Two Pair, Three of a Kind, etc., card combinations. In order to further aid the player in recognizing the aforementioned combinations, card suits are color-coded in the following manner: diamonds=blue; hearts =red; spades=black; and clubs=green.

The player may attempt to improve the ranking of the five-card hand by discarding up to five cards and replacing them with new cards (i.e., a modified hand) randomly generated by CPU 68 from the same pool as the originally dealt cards. The player identifies the cards he or she wants to retain by activating buttons 48 which correspond to those cards (Step 112). The player may reverse this decision by activating the same buttons 48 for a second time, thus releasing the hold on the previously identified cards.

To discard the unwanted cards, the player presses button 46 (Step 114). The discarded cards are automatically replaced with the same number of new cards. Simultaneously, the single card located in area 56 is displayed face up. The face value of the card displayed in area 56 determines the wild cards in this round of the game. All cards in the five-card hand which have the same face value as the card displayed in area 56 are designated wild, i.e., they may possess any specified value. CPU 68 evaluates the ranking of the five-card hand and, when wild cards are present, assigns to it the highest allowable caliber made possible by the wild cards (Step 116). The card displayed in area 56 does not actively participate in the determination of the player's five-card-hand ranking. However, since it is generated from the same pool of elements as the player's cards, the number of maximum possible wild cards the player's hand may contain is limited to three.

The player's winnings are determined on the basis of the final five-card-hand ranking and jackpot amounts are calculated according to a pay schedule such as the following:

| Hand Rank | Bonus Payment |
|---|---|
| Royal Flush (without wild cards) | 500 X BET |
| Five of a Kind | 250 X BET |
| Royal Flush (with wild cards) | 200 X BET |
| Straight Flush | 25 X BET |
| Four of a Kind | 5 X BET |
| Full House | 4 X BET |
| Flush | 4 X BET |
| Straight | 3 X BET |
| Three of a Kind | 2 X BET |
| Two Pair | 2 X BET |
| One Pair (Jacks or Better) | 1 X BET |

To collect the winnings, the player presses collect button 42 (Step 118). The coins are dispensed through coin outlet 52.

The card game is attractive to players because the wild cards make it possible to win large jackpots on small wagers. Moreover, since the wild cards are declared only after the player has a chance to alter his or her hand, an exciting element of surprise is introduced into the game. Also, the pay schedule is fixed throughout the game and no additional wagers are required during the round.

FIG. 4—TABLE VERSION OF GAME—DESCRIPTION OF PLAYING AREA

Figure 4:
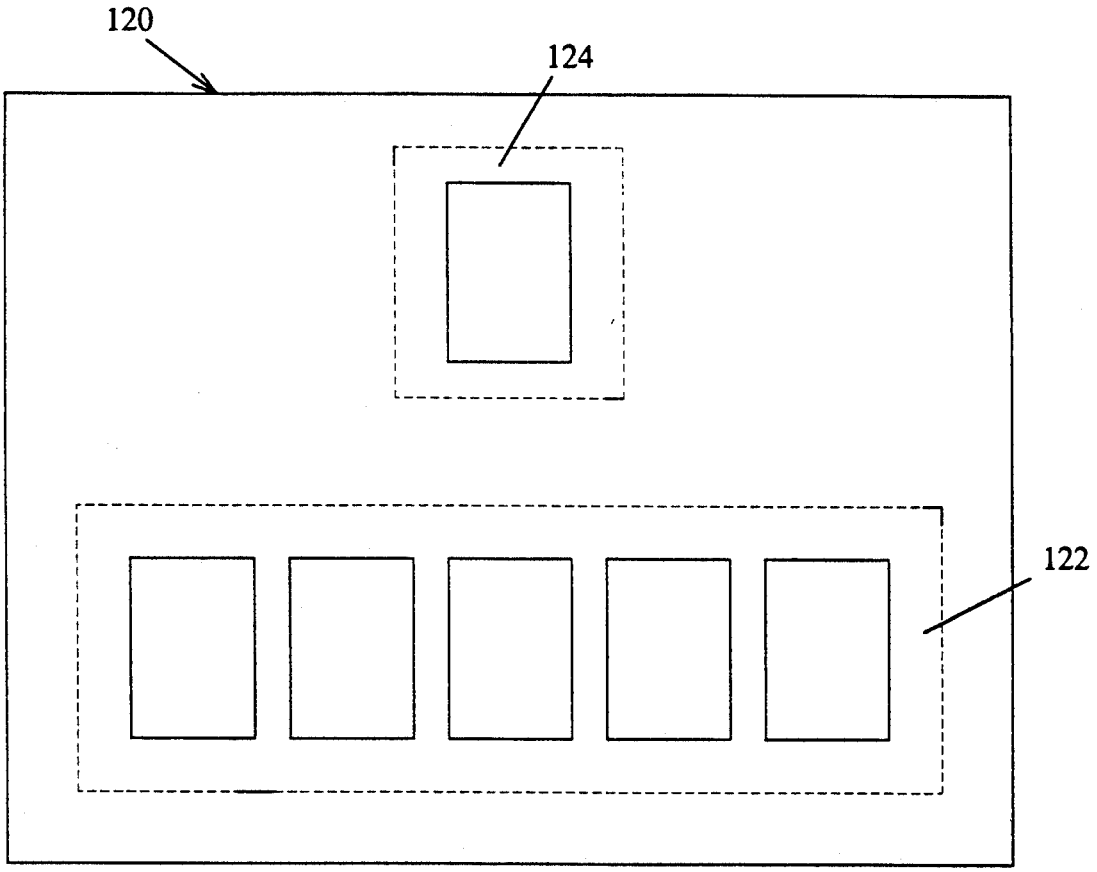
FIG. 4 is a plan view of a playing area of a card table according to the invention.

A plan view of a playing area according to the table-game version of the present invention is shown in FIG. 4.

In the table version of the card game a master deck of 52 standard playing cards which are ranked from low to high in the order of 2, 3, 4, 5, 6, 7, 8, 9, 10, Jack, Queen, King, and Ace is utilized along with a playing table (not shown). The playing table surface contains a plurality of player stations, such as station 120. Each player station includes a player-hand area 122 and a single-card area 124.

FIG. 4—TABLE VERSION OF GAME—METHOD OF PLAYING

After making a wager, each player is dealt a hand of five cards which is placed in area 122. The player also receives a solitary card which is dealt face down in area 124.

The player may attempt to improve the ranking of the five-card hand by discarding up to five cards and replacing them with new cards randomly dealt from the master deck. Once the player rearranges the five-card hand, the solitary card located in area 124 is turned face up and its face value determines the wild cards in this round of the game. All cards in the five-card hand which have the same face value as the card displayed in area 124 are designated wild, i.e., they may possess any specified value which most improves the ranking of the five-card hand. If the five-card hand contains any wild cards, its ranking is reevaluated. The ranking of the five-card hand is then compared to the rankings of other players' hands in order to determine which of the players has won the wager.

SUMMARY, RAMIFICATIONS, AND SCOPE

Thus, it has been shown that we have provided an card game of chance and skill which is profitable to casinos and attractive to players because it yields large payouts on small wagers. This game is played quickly and offers an exciting element of surprise.

Although the game has been described in the form of several specific embodiments, its arrangements and configurations are given only as examples, and many other variations of the game are possible. For example, in one version of the game only number cards, and not face cards such as Jacks, Queens, or Kings, may be wild. Moreover, the game may be structured in such a manner that four wild cards are possible in the five-card hand. This may be achieved by generating the indicator wild card from a different pool of elements than the actual playing cards. The game may be played as a table version as well as a computer version. The card-game apparatus may utilize a touch-sensitive screen, a mouse, or a light pen in order to manipulate the card images. Other data-storage media, such as magnetic tape and paper tape, may be employed with the card-game apparatus. Furthermore, paper-ticket printers may be utilized instead of coin hoppers. Different types of guiding symbols may be used in the video version of the game in order to help the player evaluate his or her hand. Therefore, the scope of the invention should be determined, not by the examples given, but by the appended claims and their legal equivalents.

What we claim is:

1. A method of playing a game of chance utilizing a maximum set with a finite plurality of scorable units, each having a fixed value, wherein said scorable units can be assembled, according to predetermined rules, into small sets having different rankings, said method comprising the steps of:

a player placing a water;

said player receiving an original set of A scorable units randomly chosen from said finite plurality of scorable units, where A is an integer, said original set having a ranking known to said player, thereby reducing said maximum set by the number of scorable units in said original sets, said player receiving a solitary scorable unit randomly chosen from said finite plurality of scorable units, said solitary scorable unit having a value concealed from said player, thereby reducing said maximum set by one additional unit;

said player having a chance to improve said ranking of said original set by discarding up to A scorable units from said original set and replacing them with an equal number of scorable units randomly chosen from said finite plurality of scorable units, thus forming a modified original set;

the value of said solitary scorable unit being revealed to said player;

all scorable units of said modified original set which have the same value as said solitary scorable unit being assigned replacement arbitrary values which maximally improve the ranking of said modified original set; and evaluating the ranking of said modified original set in accordance with predefined criteria in order to determine whether said player has won or lost said wager.

2. The method recited in claim 1 wherein said finite plurality of scorable units is a deck of playing cards.

3. The method recited in claim 2 wherein said deck of playing cards contains 52 cards.

4. The method recited in claim 1 wherein said predetermined rules are low-ball poker rules.

5. The method recited in claim 1 wherein said predetermined rules are high-ball poker rules.

6. The method recited in claim 1 wherein A=5.

7. The method recited in claim 1 wherein said predefined criteria comprise a statistical pay table.

8. A method of playing a game of chance utilizing a computerized video-game apparatus capable of generating and displaying images of playing cards wherein said playing cards can be assembled, according to predetermined rules, into hands having different card combinations, said method comprising the steps of:

a player registering a wager with said computerized video-game apparatus;

said player directing said computerized video-game apparatus to display an original hand of A cards randomly generated from a pool of elements corresponding to a deck of playing cards, where A is an integer, said original hand having a ranking known to said player;

said computerized video-game apparatus displaying guiding means for helping said player to evaluate the ranking of said original set;

said computerized video-game apparatus displaying a solitary card randomly generated from said pool of elements, said solitary card having a value concealed from said player;

said player having a chance to improve the ranking of said original set by instructing said computerized video-game apparatus to discard up to A cards from said original hand and to replace them with an equal number of cards randomly generated from said pool of elements, thus forming a modified original hand;

said computerized video-game apparatus revealing the value of said solitary card to said player;

said computerized video-game apparatus assigning arbitrary replacement to all cards of said modified original hand which have the same value as said solitary card so that the ranking of said modified original hand is improved; and said computerized video-game apparatus evaluating said ranking of said modified original hand in accordance with predefined criteria in order to determine whether said player has won or lost said wages.

9. The method recited in claim 8 wherein said predetermined rules are low-ball poker rules.

10. The method recited in claim 8 wherein said predetermined rules are high-ball poker rules.

11. The method recited in claim 8 wherein said different card combinations are high card, one-pair, two-pair, three-of-a-kind, straight, flush, full house, four-of-a-kind, straight flush, royal flush, and five-of-a-kind.

12. The method recited in claim 8 wherein said deck of playing cards contains 52 cards.

13. The method recited in claim 8 wherein said guiding means comprises identification symbols pointing out particular cards of said original hand forming any of said different card combinations.

14. The method recited in claim 13 wherein said identification symbols comprise A graphic shapes, each of said graphic shapes being located proximate its respective card of said original hand.

15. The method recited in claim 14 wherein A=5.

16. The method recited in claim 8 wherein said predefined criteria comprise a statistical pay table.

17. A method of playing a game of chance utilizing a computerized video-game machine capable of generating and displaying images of playing cards wherein said playing cards can form, according to predetermined rules, into hands having high cards, one-pair, two-pair, three-of-a-king, straight, flush, full house, four-of-a-kind, straight flush, royal flush, and five-of-a-kind combinations, said method comprising the steps of:

a player registering a wager with said computerized video-game machine;

said player directing said computerized video-game machine to display an original hand of five cards randomly generated from a pool of elements corresponding to a fifty-two-card deck of playing cards, said original hand having a ranking known to said player;

said computerized video-game machine displaying identification symbols pointing out particular cards of said original hand forming any of said high card, one-pair, two-pair, three-of-a-king, straight, flush, full house, four-of-a-kind, straight flush, royal flush, and five-of-a-king combinations;

said computerized video-game machine displaying a solitary card randomly generated from said pool of elements, said solitary card having a value concealed from said player;

said player having a chance to improve the ranking of said original hand by instructing said computerized video-game machine to discard up to five cards from said original hand and to replace them with an equal number of cards randomly generated from said pool of elements, thus forming a modified original hand;

said computerized video-game machine revealing the value of said solitary card to said player;

said computerized video-game machine assigning arbitrary replacement to all cards of said modified original hand which have the same value as said solitary card so that the ranking of said modified original hand is improved; and said computerized video-game machine evaluating the ranking of said modified original hand in accordance with a statistical pay table.

18. The method recited in claim 17 wherein said predetermined rules are high-ball poker rules.

19. The method recited in claim 17 wherein said predetermined rules are low-ball poker rules.

20. The method recited in claim 17 wherein said identification symbols comprise five graphic shapes, each of said graphic shapes being located proximate its respective card of said original hand.

* * * * *